US008819938B2

(12) United States Patent
Hasegawa et al.

(10) Patent No.: US 8,819,938 B2
(45) Date of Patent: Sep. 2, 2014

(54) PANEL POSITIONING APPARATUS AND PANEL INTEGRATION METHOD

(75) Inventors: Eisaku Hasegawa, Tochigi (JP); Nobuhiro Kozasa, Tochigi (JP); Shunsuke Ishii, Tochigi (JP); Hitoshi Yoshimichi, Tochigi (JP); Koki Sanada, Tochigi (JP)

(73) Assignee: Honda Motor Co., Ltd., Tokyo (JP)

( * ) Notice: Subject to any disclaimer, the term of this patent is extended or adjusted under 35 U.S.C. 154(b) by 403 days.

(21) Appl. No.: 13/322,162

(22) PCT Filed: May 26, 2010

(86) PCT No.: PCT/JP2010/058921

§ 371 (c)(1),
(2), (4) Date: Jan. 19, 2012

(87) PCT Pub. No.: WO2010/137622

PCT Pub. Date: Dec. 2, 2010

(65) Prior Publication Data

US 2012/0117783 A1 May 17, 2012

(30) Foreign Application Priority Data

May 26, 2009 (JP) ..... 2009-126908

(51) Int. Cl.

| | |
|---|---|
| ***B23P 19/00*** | (2006.01) |
| ***B23P 11/00*** | (2006.01) |
| ***B21D 39/00*** | (2006.01) |
| ***B21D 39/02*** | (2006.01) |
| ***B21D 43/00*** | (2006.01) |

(52) U.S. Cl.

CPC ..... *B21D 39/021* (2013.01); *B21D 43/003* (2013.01); *Y10S 901/39* (2013.01)

USPC ..... 29/897.32; 29/464; 29/509; 29/243.58; 901/39; 269/43

(58) Field of Classification Search

CPC ..... B25B 27/14; B21D 39/00; B21D 39/02; B23P 11/00

USPC ..... 29/897.2, 897.3, 897.32, 271, 281.2, 29/281.3, 281.5, 464, 468, 509, 243.58; 901/31, 39, 41, 36; 269/37, 40, 43

See application file for complete search history.

(56) References Cited

U.S. PATENT DOCUMENTS 3,719,980 A * 3/1973 Van Bussel ..... 29/892.11
5,237,734 A * 8/1993 Polon ..... 29/513

(Continued)

FOREIGN PATENT DOCUMENTS

EP 1925379 5/2008
JP 5-27213 7/1993

(Continued)

OTHER PUBLICATIONS

Chinese Office Action dated Mar. 18, 2014, 6 pages.

*Primary Examiner* — David Bryant
*Assistant Examiner* — Jason L Vaughan
(74) *Attorney, Agent, or Firm* — Rankin, Hill & Clark LLP

(57) ABSTRACT

A panel positioning apparatus is provided with an outer panel supporting device 20 adapted to support the outer panel 11 from a lower side of the outer panel 11 and an inner panel supporting device 30 adapted to support the inner panel 12 from an upper side of the inner panel 12. The outer panel supporting device 20 has a lower-surface contact section 23 adapted to abut against a lower surface of the outer panel 11. The inner panel supporting device 30 has an upper-surface contact section 344 adapted to expose below the inner panel 12 and to abut against an upper surface of a part of the outer panel 12 against which the lower-surface contact section 23 abuts. The outer panel 11 and the inner panel 12 are overlaid with each other, and a bending part 112A of the outer panel 11 is bent by pinching the outer panel 11 by the lower-surface contact section 23 and the upper-surface contact section 334.

3 Claims, 6 Drawing Sheets

(56) References Cited

U.S. PATENT DOCUMENTS

| | | | | |
|---|---|---|---|---|
| 5,611,133 | A * | 3/1997 | Toeniskoetter | 29/509 |
| 5,752,304 | A * | 5/1998 | Toeniskoetter | 29/243.58 |
| 5,787,646 | A * | 8/1998 | Nakamori | 49/502 |
| 6,029,334 | A * | 2/2000 | Hartley | 29/464 |
| 7,222,416 | B2 * | 5/2007 | Baba et al. | 29/796 |
| 7,607,331 | B2 * | 10/2009 | Carsley et al. | 72/306 |
| 2010/0252973 | A1 | 10/2010 | Reith et al. | |

FOREIGN PATENT DOCUMENTS

| | | |
|---|---|---|
| JP | 2005-014069 | 1/2005 |
| JP | 2007/110235 | 10/2007 |

* cited by examiner

PANEL POSITIONING APPARATUS AND PANEL INTEGRATION METHOD

TECHNICAL FIELD

The present invention relates to a panel positioning apparatus and a panel integration method. In particular, the present invention relates to a panel positioning apparatus for positioning an outer panel and an inner panel with each other and a panel integration method of integrating these panels.

BACKGROUND ART

A panel such as a door panel and a bonnet of an automobile is conventionally constructed by integrating an outer panel on an outer side with an inner panel on an inner side. Such a panel is fabricated by a marriage process of overlaying the outer panel and the inner panel with each other by a panel positioning apparatus and a hemming process of integrating with each other the outer panel and the inner panel overlaid in the marriage process (see Patent Document 1).

Specifically, the panel positioning apparatus is provided with an outer panel supporting device for supporting the outer panel from a lower side, and an inner panel supporting device for supporting the inner panel from an upper side. The outer panel supporting device is provided with a placement section onto which the outer panel is placed, and a frame that is provided in a rotatable manner in the placement section and that extends to an outside along the surface of the outer panel. On a tip side of the frame of the outer panel supporting device, a through hole is formed.

The inner panel supporting device is provided with a holding section for holding the inner panel, and a frame that is provided in a rotatable manner in the holding section and that extends to an outside along the surface of the inner panel. On a tip side of the frame of the inner panel supporting device, a positioning pin is formed. The positioning pin can be inserted into a through hole of the frame of the outer panel supporting device.

The above-mentioned panel positioning apparatus operates as follows. First, a peripheral part of the outer panel is bent upward so that a bent part is formed. Then, the outer panel is placed on the placement section of the outer panel supporting device. Further, the holding section of the inner panel supporting device holds the inner panel.

Then, a marriage process is performed that the inner panel supporting device is moved so that the inner panel is overlaid onto the outer panel. At that time, the positioning pin of the frame of the inner panel supporting device is inserted into the through hole of the frame of the outer panel supporting device so as to position the inner panel relative to the outer panel and further prevent a deviation in the relative position of the inner panel relative to the outer panel.

Then, a hemming process is performed that a hemming device bends further the bent part of the outer panel so as to firmly stick the bent part to the peripheral part of the inner panel. Here, the frames of the inner panel supporting device and the outer panel supporting device are rotated such that these frames do not interfere with the hemming device. In this way, the outer panel and the inner panel are integrated with each other.

However, in the above-mentioned method, a device for rotating the frames is required to be provided in the outer panel supporting device or the inner panel supporting device. This causes a problem of size increase in the panel positioning apparatus. Further, the direction of insertion of the positioning pin into the through hole is fixed. Thus, in the marriage process, the direction of approaching of the inner panel to the outer panel is limited. Accordingly, depending on the angle of the bent part, a possibility arises that the edge of the inner panel interferes with the bent part so that

PRIOR ART REFERENCE

Patent Document

Patent Document 1: WO2007/110235

SUMMARY OF INVENTION

One or more embodiments of the present invention provide a panel positioning apparatus and a panel integration method in which size reduction is achievable and marriage is achieved regardless of the angle of a bent part of an outer panel.

The panel positioning apparatus (e.g., a later-described panel positioning apparatus 1) according to an exemplary embodiment is a panel positioning apparatus for overlaying an inner panel (e.g., a later-described inner panel 12) onto an outer panel (e.g., a later-described outer panel 11) and then positioning the outer panel and the inner panel with each other, and is provided with: an outer panel supporting device (e.g., a later-described outer panel supporting device 20) for supporting the outer panel from a lower side; and an inner panel supporting device (e.g., a later-described inner panel supporting device 30) for supporting the inner panel from an upper side, in which the outer panel supporting device has a lower-surface contact section (e.g., a first lower-surface contact section 23 and a fourth lower-surface contact section 26 described later) to abut against the lower surface of the outer panel, and in which the inner panel supporting device has an upper-surface contact section (e.g., a front-side upper-surface contact section 344 and a rear-side upper-surface contact section 364) that exposes below the inner panel and abuts against the upper surface of the part of the outer panel against which the lower-surface contact section abuts.

Further, the panel integration method according to the exemplary embodiment is a panel integration method of overlaying an inner panel onto an outer panel and then bending a peripheral part of the outer panel bent so as to integrate the outer panel and the inner panel with each other, and including the steps of: supporting the outer panel from a lower side by an outer panel supporting device and abutting a lower-surface contact section against a lower surface of the outer panel; supporting the inner panel from an upper side by an inner panel supporting device at a part not located at a peripheral part and exposing an upper-surface contact section below the inner panel; moving at least one of the outer panel supporting device and the inner panel supporting device so as to overlay the outer panel and the inner panel with each other and pinching the outer panel by the lower-surface contact section of the outer panel supporting device and the upper-surface contact section of the inner panel supporting device; and bending a peripheral part of the outer panel.

According to an exemplary embodiment, an outer panel and an inner panel are positioned and integrated with each other in the following procedure. An outer panel is prepared. Then, an outer panel supporting device supports the outer panel from the lower side. In this state, lower-surface contact sections abut against the lower surface of the outer panel. Further, an inner panel supporting device supports the inner panel from the upper side. In this state, upper-surface contact sections are exposed under the inner panel.

Then, in this state, at least one of the outer panel supporting device and the inner panel supporting device is moved so that the outer panel and the inner panel become close to each other and then marriage is performed. At that time, the upper-surface contact sections abut against the upper surface of the part of the outer panel against which the lower-surface contact sections abut. Thus, the outer panel is pinched by the lower-surface contact sections of the outer panel supporting device and the upper-surface contact sections of the inner panel supporting device. Then, a hemming device bends a peripheral part of the outer panel.

Thus, the conventional necessity that the outer panel supporting device and the inner panel supporting device extend to the outside of the outer panel and the inner panel is avoided. This permits size reduction. Further, the lower-surface contact sections and the upper-surface contact sections pinch the outer panel so as to prevent a deviation in the relative position of the inner panel relative to the outer panel. Thus, at the time of marriage of the inner panel to the outer panel, the direction of approaching of the inner panel to the outer panel is not limited. This permits the marriage regardless of the angle of the bent part of the outer panel.

Other aspects and advantages of the invention will be apparent from the following description and the appended claims.

DESCRIPTION OF EMBODIMENTS

Figure 1:
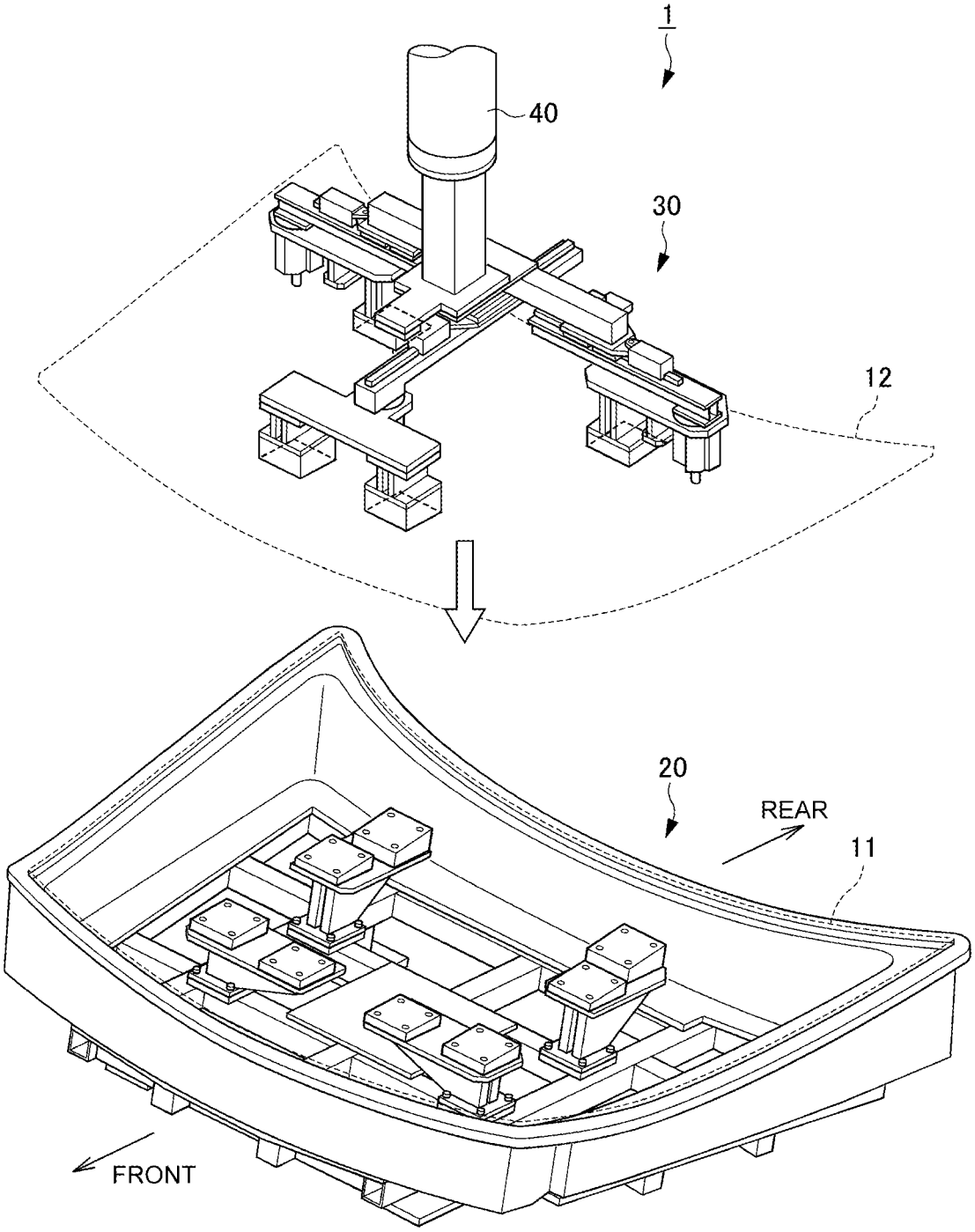
FIG. 1 is an overall perspective view of a panel positioning apparatus according to an exemplary embodiment.

An exemplary embodiment of the present invention is described below with reference to the drawings. FIG. 1 is an overall perspective view of a panel positioning apparatus 1 according to the exemplary embodiment of the present invention. The panel positioning apparatus 1 is used for overlaying an outer panel 11 and an inner panel 12 with each other.

The panel positioning apparatus 1 is provided with an outer panel supporting device 20 serving as an outer panel supporting device for supporting the outer panel 11 from a lower side, an inner panel supporting device 30 serving as an inner panel supporting device for supporting the inner panel 12 from an upper side, and a robot arm 40 for moving the inner panel supporting device 30. Specifically, the robot arm 40 changes the position and the orientation of the inner panel supporting device 30 in the three-dimensional space. Here, in the following description, the lower left direction in FIG. 1 is defined as a front direction and the upper right direction in FIG. 1 is defined as a rear direction.

Figure 2:
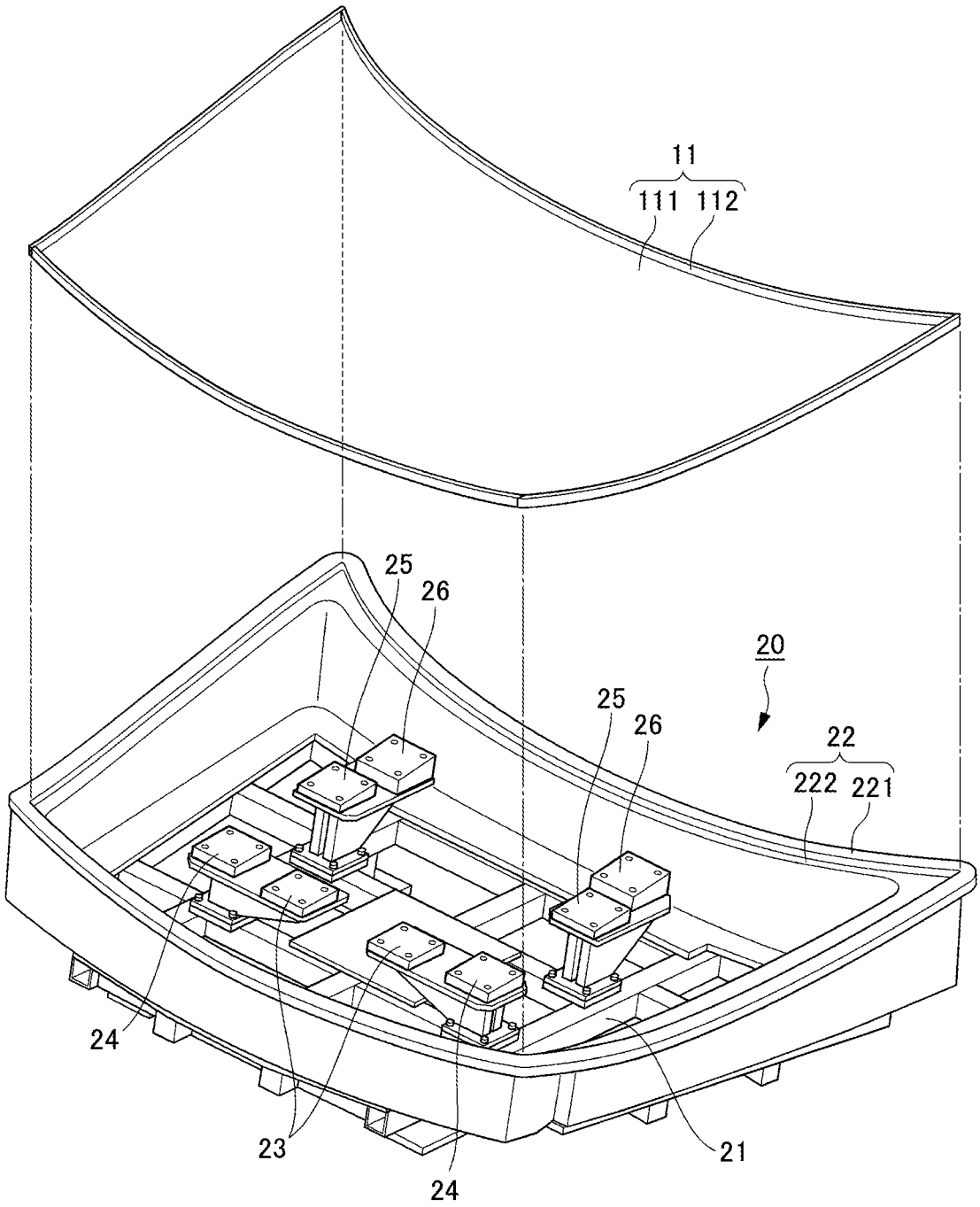
FIG. 2 is a perspective view of an outer panel supporting device of a panel positioning apparatus according to the above-mentioned exemplary embodiment.

FIG. 2 is a perspective view of the outer panel supporting device 20. The outer panel 11 is provided with a flat-plate part 111 having a rectangular flat-plate shape, and a bent part 112 serving as a peripheral part formed in the periphery of the flat-plate part 111. Specifically, the bent part 112 is formed by preparing a panel with a rectangular flat-plate shape and then bending the periphery of the panel.

The outer panel supporting device 20 is provided with abase section 21 having a rectangular flat-plate shape arranged on the floor, a wall section 22 standing in the outer peripheral part of the base section 21, and a plurality of the lower-surface contact sections 23 to 26 provided near the center of the base section 21.

The upper surface of the wall section 22 is constructed from: an outer-periphery-side upper surface 221; and an inner-periphery-side upper surface 222 lower than the outer-periphery-side upper surface 221. A level difference is formed between the outer-periphery-side upper surface 221 and the inner-periphery-side upper surface 222.

The lower-surface contact sections 23 to 26 have contact surfaces having a rectangular shape. The lower-surface contact sections 23 to 26 includes a pair of first lower-surface contact sections 23 provided approximately in the center in the width direction on the front side of the first panel device, a pair of second lower-surface contact sections 24 provided on the side of the pair of first lower-surface contact sections 23, a pair of third lower-surface contact sections 25 provided on the rear side of the pair of second lower-surface contact sections 24, and a pair of fourth lower-surface contact sections 26 provided on the rear side of the pair of third lower-surface contact sections 25.

The outer panel 11 is placed on the above-mentioned outer panel supporting device 20. Then, the lower-surface contact sections 23 to 26 abut against and support a part near the center of the flat-plate part 111 of the outer panel 11. Further, the wall section 22 abuts against and supports a part near the bent part 112 of the flat-plate part 111 of the outer panel 11. Further, the bent part 112 of the outer panel 11 is fit into the level difference between the outer-periphery-side upper surface 221 and the inner-periphery-side upper surface 222 of the wall section 22. As a result, the outer panel 11 is positioned by the outer panel supporting device 20.

Figure 3:
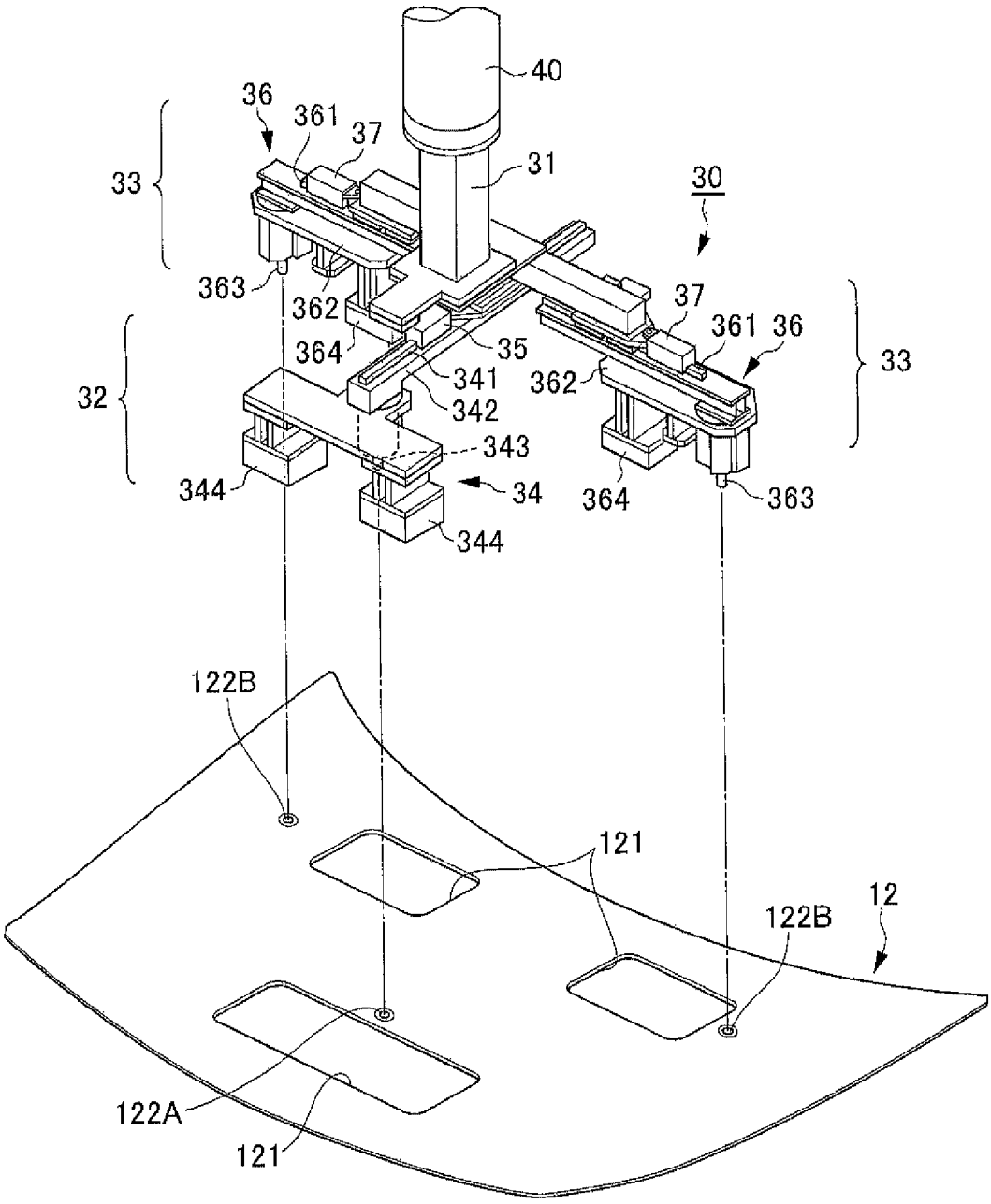
FIG. 3 is a perspective view of an inner panel supporting device of a panel positioning apparatus according to the above-mentioned exemplary embodiment.

FIG. 3 is a perspective view of the inner panel supporting device 30. The inner panel 12 has a rectangular flat-plate shape. In the inner panel 12, a plurality of openings 121 and a plurality of through holes 122 are formed. Here, a through hole 122 located on the front side in the center in width direction of the inner panel 12 is referred to as a through hole 122A. A pair of through holes 122 located on the rear side at both ends in the width direction are referred to as through holes 122B. These through holes 122A and 122B are formed in a part not located at a peripheral part of the inner panel 12, that is, in a part near the center of the inner panel 12.

The inner panel supporting device 30 is provided with a base section 31 provided in the tip flange surface of the robot arm 40, a front-side support section 32 provided in the base section 31, and a pair of rear side support parts 33 provided in the base section 31. The base section 31 extends in a direction approximately perpendicular to the tip flange surface of the robot arm 40.

The front-side support section 32 is provided with a slide section 34 provided with a slide rail 341, and a guide part 35 which is provided on the tip side of the base section 31 and into which the slide rail 341 is fit. The slide section 34 is provided with a slide section body 342 in which the slide rail 341 is formed, a front-side pin 343 protruding from the slide section body 342, and a pair of front-side upper-surface contact sections 344 provided in front of the front-side pin 343 of the slide section body 342. In the slide section 34, when the slide rail 341 slides relative to the guide part 35 so as to move in a direction perpendicular to the extending direction of the base section 31 so that the position of the front-side pin 343 and the pair of front-side upper-surface contact sections 344 is adjusted.

Each of the rear-side support section 33 is provided with: a slide section 36 provided with a slide rail 361, and a guide part 37 which is provided on the tip side of the base section 31 and into which the slide rail 361 is fit. The slide section 36 is provided with a slide section body 362 in which the slide rail 361 is formed, a rear-side pin 363 protruding from the slide section body 362, and a rear-side upper-surface contact section 364 provided in a part near the center relative to the rear-side pin 363 of the slide section body 362. In the slide section 36, when the slide rail 361 slides relative to the guide part 37 so as to move in a direction perpendicular to the extending direction of the base section 31 and the extending direction of the front-side support section 32 so that the position of the rear-side pin 363 and the rear-side upper-surface contact section 364 is adjusted.

In the above-mentioned inner panel supporting device 30, the front-side pin 343 is inserted into the through hole 122A of the inner panel 12 and the rear-side pins 363 are inserted into the through holes 122B of the inner panel 12 so that the inner panel 12 is supported. At that time, the front-side upper-surface contact sections 344 and the rear-side upper-surface contact sections 364 are inserted into a plurality of openings 121 so as to be exposed under the inner panel 12.

Next, a method of integrating the outer panel 11 and the inner panel 12 with each other by using the panel positioning apparatus 1 is described below with reference to FIGS. 4 to 6. Here, in following FIGS. 4 to 6, for simplicity of understanding, the upper-surface contact sections 344 alone are shown among the upper-surface contact sections 344 and 346. Further, the lower-surface contact sections 23 alone are shown among the lower-surface contact sections 23 to 26, and the pin 343 alone is shown among the pins 343 and 363.

Figure 4:
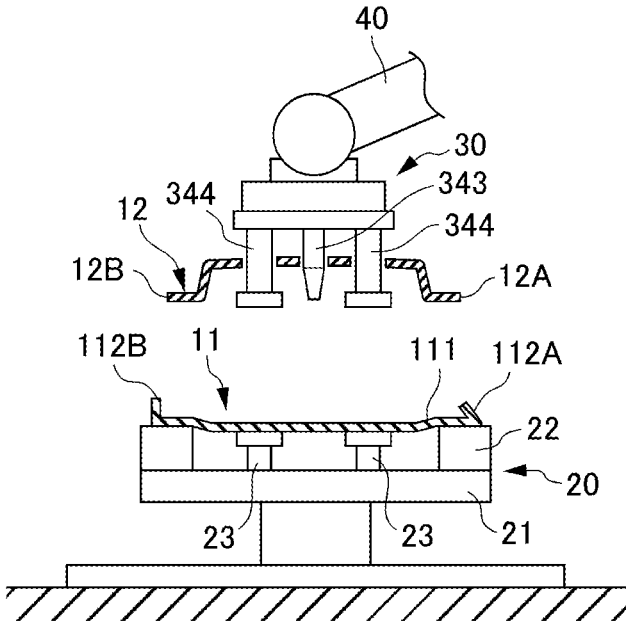
FIG. 4 is a schematic diagram (part 1) for describing the operation of a panel positioning apparatus according to the above-mentioned exemplary embodiment.
Figure 5:
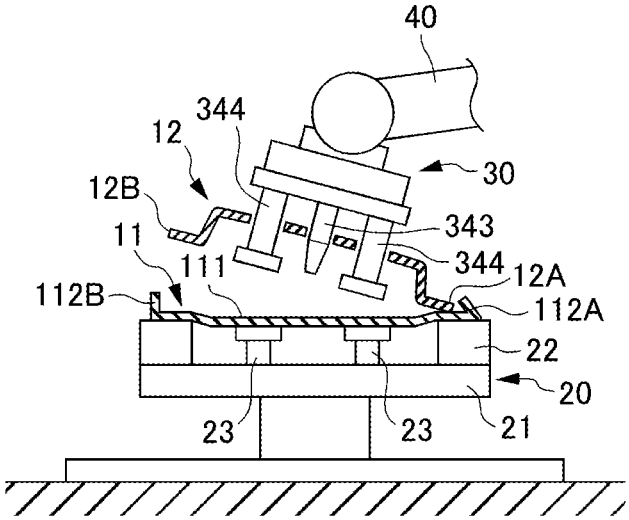
FIG. 5 is a schematic diagram (part 2) for describing the operation of a panel positioning apparatus according to the above-mentioned exemplary embodiment.

First, as shown in FIG. 4, the outer panel 11 is placed on the outer panel supporting device 20 so that the outer panel 11 is positioned relative to the outer panel supporting device 20. Then, the flat-plate part 111 of the outer panel 11 is supported by the lower-surface contact sections 23 to 26. Here, in the outer panel 11, the bent part 112 on the right side in FIG. 4 corresponds to the bent part 112A having been bent in an acute angle relative to the flat-plate part 111. Further, the bent part 112 on the left side in FIG. 4 corresponds to the bent part 112B having been bent approximately at right angles relative to the flat-plate part 111.

Further, the front-side pin 343 of the inner panel supporting device 30 is inserted into the through hole 122A of the inner panel 12 and the rear-side pins 363 are inserted into the through holes 122B of the inner panel 12 so that the inner panel 12 is supported. Here, the edge on the right side in FIG. 4 of the inner panel 12 is referred to as an edge 12A and the edge on the left side in FIG. 4 is referred to as an edge 12B.

Then, the inner panel 12 is overlaid onto the outer panel 11 and then marriage is performed. Here, when the inner panel 12 approaches the outer panel 11 from the upper side, the edge 12A of the inner panel 12 interferes with the bent part 112B. Thus, as shown in FIG. 5, the robot arm 40 is controlled such that the inner panel 12 approaches the outer panel 11 from the upper left direction in FIG. 5 so that the edge 12A of the inner panel 12 is inserted between the bent part 112A and the flat-plate part 111.

Figure 6:
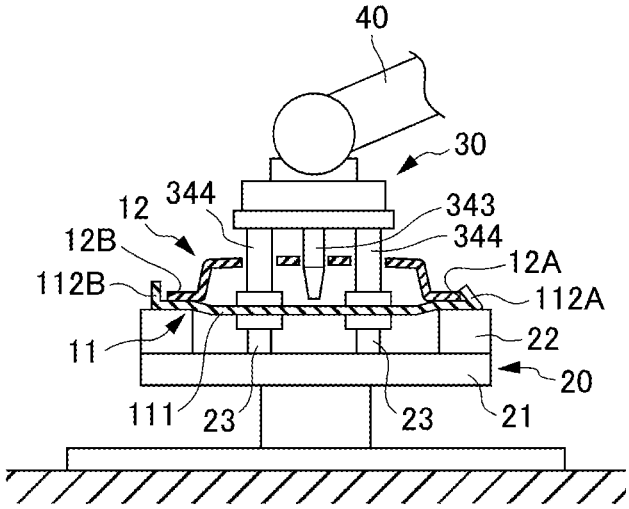
FIG. 6 is a schematic diagram (part 3) for describing the operation of a panel positioning apparatus according to the above-mentioned exemplary embodiment.

Then, as shown in FIG. 6, the edge 12B of the inner panel 12 is inserted between the bent part 112B and the flat-plate part 111 from the upper side of the inner panel 12. Then, the inner panel supporting device 30 is pressed against the outer panel supporting device 20.

Figure 7:
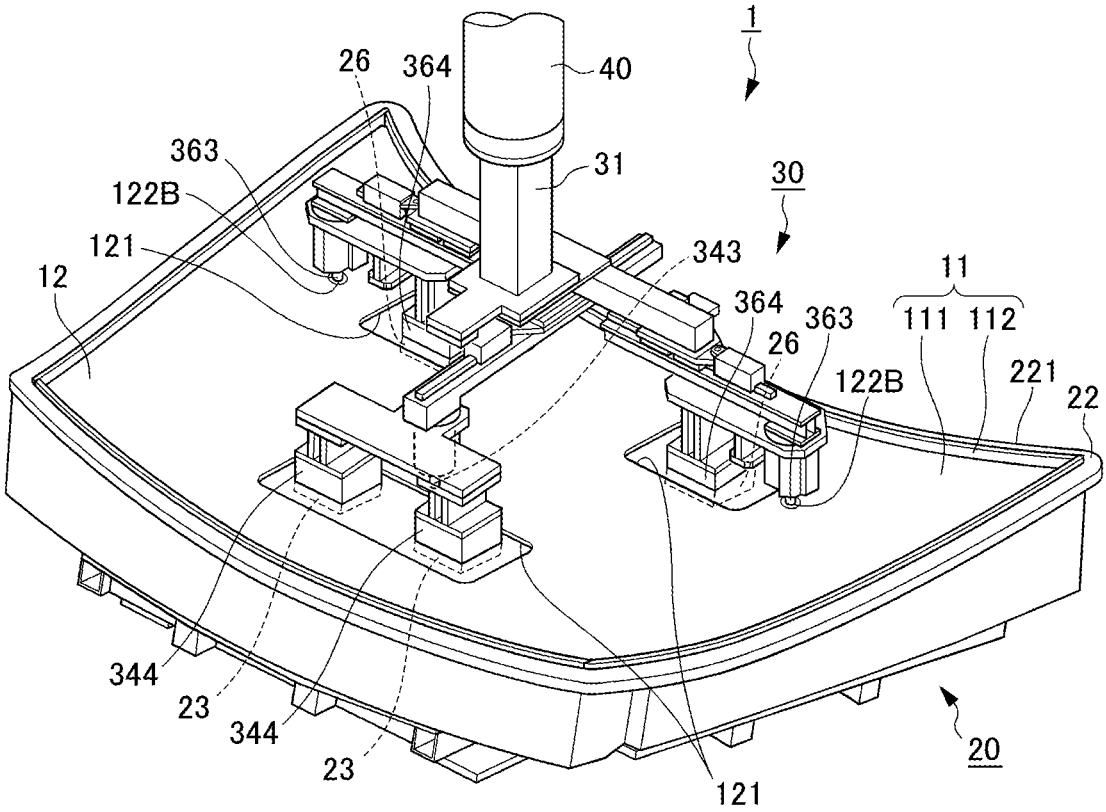
FIG. 7 is a perspective view showing a state that panels are overlaid in a panel positioning apparatus according to the above-mentioned exemplary embodiment.

Then, as shown also in FIG. 7, the upper-surface contact sections 344 and 364 abut against the upper surface of the part against which the lower-surface contact sections 23 and 26 abut. Thus, the lower-surface contact sections 23 of the outer panel supporting device 20 and the front-side upper-surface contact sections 344 of the inner panel supporting device 30 pinch the front side of the outer panel 11. Further, the lower-surface contact sections 26 of the outer panel supporting device 20 and the rear-side upper-surface contact sections 364 of the inner panel supporting device 30 pinch the rear side of the outer panel 11.

Then, a hemming device (not shown) presses and bends further the bent parts 112A and 112B so as to establish close contact with the peripheral part of the inner panel 12. As a result, the outer panel 11 and the inner panel 12 are integrated with each other in the peripheral part.

According to the exemplary embodiment, the following effects are obtained. (1) The necessity in the prior art that the outer panel supporting device and the inner panel supporting device extend to the outside of the outer panel and the inner panel is avoided. This permits size reduction. (2) Further, the outer panel 11 is pinched by the lower-surface contact sections 23 and 26 of the outer panel supporting device 20 and the upper-surface contact sections 344 and 364 of the inner panel supporting device 30 so that a deviation is prevented in the relative position of the inner panel 12 relative to the outer panel 11. Thus, at the time of marriage of the inner panel 12 to the outer panel 11, the direction of approaching of the inner panel 12 to the outer panel 11 is not limited. This permits the marriage regardless of the angle of the bent part 112 of the outer panel 11.

Here, the present invention is not limited to the above-mentioned exemplary embodiment. That is, modifications and improvements made for achieving the object of the present invention are included within the scope of the present invention.

INDUSTRIAL APPLICABILITY

The present invention is applicable, for example, in a process of integrating a plurality of panels.

DESCRIPTION OF REFERENCE NUMERALS

1 Panel Positioning Apparatus
11 Outer Panel
12 Inner Panel
20 Outer Panel Supporting Device
23 First Lower-Surface Contact Section
26 Fourth Lower-Surface Contact Section
30 Inner Panel Supporting Device
112 Bent Part (peripheral part)
344 Front-Side Upper-Surface Contact Section
364 Rear-Side Upper-Surface Contact Section

The invention claimed is:

1. A panel positioning apparatus (1) in which an inner panel (12) is overlaid onto an outer panel (11) in a vertical direction of the panel positioning apparatus, and a positioning of the outer panel (11) and the inner panel (12) with each other is performed, the apparatus comprising:

an outer panel supporting device (20) adapted to support the outer panel (11) from a lower side of the outer panel (11) with respect to the vertical direction; and an inner panel supporting device (30) adapted to support the inner panel (12) from an upper side of the inner panel (12) with respect to the vertical direction at a part (112A, 112B) of the inner panel (12) other than a peripheral part of the inner panel (12), wherein the outer panel supporting device (20) has a lower-surface contact section (23, 26) adapted to abut against a lower surface of the outer panel (11), and wherein the inner panel supporting device (30) has an upper-surface contact section (344, 364) adapted to expose below the inner panel (12) and to abut against an upper surface of a part of the outer panel (12) against which the lower-surface contact section (23, 26) abuts such that the outer panel (11) is pinched by the lower-surface contact section (23, 26) and the upper-surface contact section (344, 364) at a part of the outer panel (11) other than a peripheral part (112A, 112B) of the outer panel (11).

2. A panel integration method of overlaying an inner panel (12) onto an outer panel (11) in a vertical direction and bending a peripheral part (112) of the outer panel (11) so as to integrate the outer panel (11) and the inner panel (12) with each other, the method comprising:

supporting the outer panel (11) from a lower side of the outer panel (11) with respect to the vertical direction by an outer panel supporting device (20), and abutting a lower-surface contact section (23, 26) of the outer panel supporting device (20) against a lower surface of the outer panel (11);

supporting the inner panel (12) from an upper side of the inner panel (12) with respect to the vertical direction by an inner panel supporting device (30) at a part (12A, 12B) of the inner panel (12) other than a peripheral part of the inner panel (12), and exposing an upper-surface contact section (344, 364) of the inner panel supporting device (30) below the inner panel (12);

relatively moving the outer panel supporting device (20) and the inner panel supporting device (30) so as to overlay the outer panel (11) and the inner panel (12) with each other, and pinching the outer panel (11) by the lower-surface contact section (23, 26) and the upper-surface contact section (344, 364) at a part of the outer panel (11) other than a peripheral part (112A, 112B) of the outer panel (11); and bending the peripheral part (112A, 112B) of the outer panel (11).

3. The panel integration method according to claim 2, wherein the inner panel (12) has an opening, and wherein the upper-surface contact section (344, 364) exposes below the inner panel (12) by inserting the upper-surface contact section (344, 364) through opening (121) of the inner panel (12).

* * * * *